United States Patent [19]

Heyrana

[11] 4,238,656

[45] Dec. 9, 1980

[54] WATERPROOF MULTIPLE ELECTRICAL SWITCH ASSEMBLY

[76] Inventor: Pablo M. Heyrana, 1839 R St., N.W., Washington, D.C. 20009

[21] Appl. No.: 16,372

[22] Filed: Mar. 1, 1979

Related U.S. Application Data

[62] Division of Ser. No. 790,418, Apr. 25, 1977, Pat. No. 4,143,254.

[51] Int. Cl.[3] ..... H01H 1/26

[52] U.S. Cl. ..... 200/283

[58] Field of Search ..... 200/239, 153 LA, 237, 200/283, 244, 246, 159 A, 67 A, 67 D

[56] References Cited

U.S. PATENT DOCUMENTS

| | | | |
|---|---|---|---|
| 2,254,720 | 9/1941 | Wilcox | 200/283 |
| 3,283,107 | 11/1966 | Anson | 200/283 |
| 3,283,274 | 11/1966 | DeFalco | 200/283 |

FOREIGN PATENT DOCUMENTS

| | | | |
|---|---|---|---|
| 1527893 | 12/1968 | France | 200/283 |

*Primary Examiner*—John W. Shepperd

*Attorney, Agent, or Firm*—Shlesinger, Arkwright, Garvey and Dinsmore

[57] ABSTRACT

An electrical blade switch including a pair of spaced contact leaves, one of which comprises a fixed portion which is hingedly connected to a movable portion for permitting deflection thereof in a direction to effect engagement of contacts on the contact leaves.

9 Claims, 4 Drawing Figures

WATERPROOF MULTIPLE ELECTRICAL SWITCH ASSEMBLY

This is a division of application Ser. No. 790,418, filed Apr. 25, 1977, now U.S. Pat. No. 4,143,254.

SUMMARY OF THE INVENTION

This invention is an electrical blade switch which comprises a pair of contact leaves separated by insulating means and having contacts in opposed relation. One of the contact leaves includes a fixed portion and a movable portion which are hingedly connected to permit the movable portion to be deflected towards the other contact leaf until the contacts are in contiguous engagement.

Springs extend between the fixed and movable portions for normally urging the movable portion to its undeflected position, and a roller rotatably supported by the movable portion engages a projection on a surface to deflect the movable portion against the tension of the springs, and effect engagement of the contacts to complete the electrical circuit.

DESCRIPTION OF THE INVENTION

Figure 1:
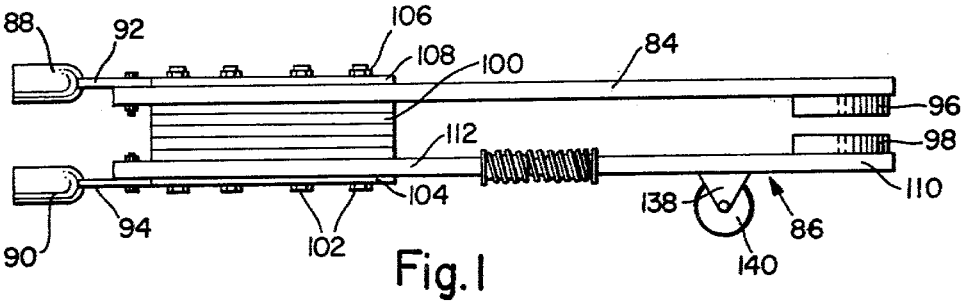
FIG. 1 is a side elevational view of the electrical blade switch of the present invention.

The electrical blade switch of the present invention.

Blade switch 76 forms a salient part of the present invention and is illustrated to advantage in FIGS. 8 to 12. The switch comprises an upper contact leaf 84 and a lower contact leaf 86. Leaf 84 is connected to electrical terminal 88 while leaf 86 is connected to electrical terminal 90. The terminals are hollow metal tubes with an open end to receive an electrical contact and a closed end connected to pieces 92 and 94 respectively, which bolt to the end of contact leaves 84 and 86. On the opposite ends of the contact leaves, circular contacts 96 and 98 are provided in facing relationship.

At a point near the terminals thereof, leaves 84 and 86 are separated by an insulator 100. Bolts 102 separated from the surface of contact 86 by insulator 104, and nuts 106 separated from contact leaf 84 by insulator 108, clamp the arms on the insulator. Insulator 100 preferably comprises a series of stacked, rectangular leaves. If desired, bolts 102 and nuts 106 may be made of an insulating material such as nylon.

Figure 2:
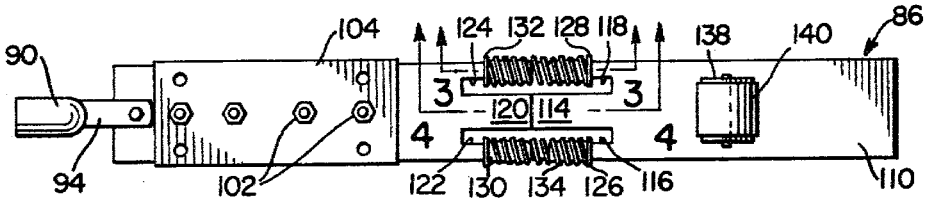
FIG. 2 is a bottom plan view of the same.

As shown to advantage in FIG. 2, lower contact leaf 86 comprises two portions, a movable contact portion 110 and a fixed terminal portion 112. The end of portion 110 proximate portion 112 includes three spaced prongs, a central prong 114 and lateral prongs 116 and 118. The end of portion 112 proximate portion 110 also includes three spaced prongs, a central prong 120 and lateral prongs 122 and 124.

The ends of prongs 114 and 120 are extended to provide interfitting curved portions 115 and 121 which forms a hinge in order to permit relative movement of movable contact portion 110 with respect to fixed terminal portion 112 in a direction to effect engagement of contacts 96 and 98.

Figure 3:
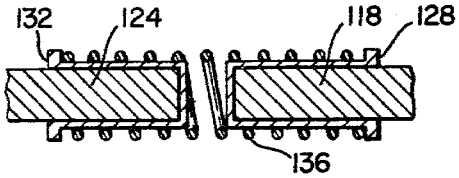
FIG. 3 is a sectional view taken along the line 3—3 of FIG. 2.
Figure 4:
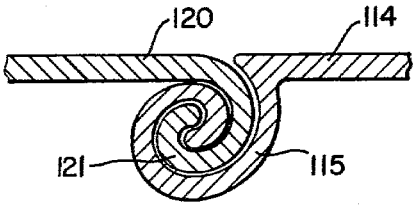
FIG. 4 is a sectional view taken along the line 4—4 of FIG. 2.

Referring to FIGS. 1, 2 and 3, the opposed ends of prongs 116 and 122, and the opposed ends of prongs 118 and 124, are slightly spaced apart and flanged insulating jacks 126, 128, 130 and 132 are positioned over prongs 116, 118, 122 and 124 respectively. A pair of helical springs 134 and 136 extend between opposed pairs of lateral prongs, the springs being positioned over the insulating jackets with the terminals of the springs engaging the flanges of the jackets. More specifically, one end of helical spring 134 is placed over insulating jacket 126 and the other end over insulating jacket 130. One end of helical spring 136 is placed over insulating jacket 128 and the other end over insulating jacket 132. The insulating jackets serve to prevent direct engagement of the springs with lower contact leaf 86, and prevent deterioration of the springs which would otherwise result when electricity passes through the switch.

The range formed by curved portions 115 and 121, shown in FIG. 12, is a locking hinge which allows contact portion 110 to freely bend towards contact leaf 84. However, the hinge locks in such a manner that movable contact portion 110 will not bend in a direction away from contact leaf 86 past the contact portion's undeflected position.

The outer face of movable contact portion 110 is provided with a mounting bracket 138 which rotatably supports a roller 140 which passes through intermediate frame 22 for engagement with a projection on a surface which is aligned with the roller.

In use, springs 134 and 136 serve to urge portions 110 and 112 together to insure good electrical connection at the hinge and additionally serve to normally retain movable contact portion 110 in its undeflected position until such time as roller 140 is in engagement with a projection. When roller 140 engages the projection, the hinge formed by curved portions 115 and 121 of fixed portion 112 and movable portion 110 permits the latter to move in the direction of contact leaf 86 against the tension of springs 134 and 136.

While there has been herein shown and described the presently preferred form of this invention, it is to be understood that such has been done for purposes of illustration only, and that various changes may be made therein within the scope of the appended claims.

What is claimed is:

1. An electrical blade switch comprising (a) a first contact leaf (b) a second contact leaf (c) insulating means for maintaining said first and second contact leaves in spaced relation (d) said second contact leaf consisting of two parts arranged in opposed, end to end relation and comprising a fixed portion and a movable portion (e) hinge means connecting said fixed and movable portions to permit deflection of the latter (f) means between, and engaged with, said fixed and movable portions, to normally urge the latter to the undeflected position, and (g) contacts on first contact leaf and the movable portion of said second contact leaf, said contacts being in opposed, spaced relation whereby, when said movable portion is deflected towards said first contact leaf by an outside force, said contacts are in contiguous engagement to complete an electrical curcuit.

2. The electrical blade switch of claim 1, wherein (a) said hinge means comprises interfitted, curvilinear extensions of said fixed and movable portions.

3. The electrical blade switch of claim 1, wherein (a) said means between, and engaged with, said fixed and movable portion comprises helical springs.

4. The electrical blade switch of claim 3 with the addition of (a) insulating members interposed between said helical springs and said fixed and movable portions.

5. The electrical blade switch of claim 1, with the addition of (a) a roller engaged with the movable portion of said second contact leaf to effect deflection of said movable portion when said roller engages a projection on a surface.

6. An electrical blade switch comprising (a) a first contact leaf (b) a second contact leaf (c) insulating means for maintaining said first and second leaves in spaced relation (d) said second leaf comprising a fixed portion and a movable portion (e) said fixed and movable portion of said second leaf being provided with central extensions (f) said central extensions being curvilinear and interfitted to form a hinge to permit deflection of said movable portion (g) said fixed and movable portions having opposed, lateral prongs (h) springs extending between, and connected to, said opposed prongs, to normally urge said movable portion to the undeflected position, and (i) contacts on said first contact leaf and the movable portion of said second contact leaf, said contacts being in opposed, spaced relation whereby, when said movable portion is deflected towards said first contact leaf by an outside force, said contacts are in contiguous engagement to complete an electrical circuit.

7. The electrical blade switch of claim 6, with the addition of (a) insulator caps placed over said lateral prongs and separating the same from said springs.

8. The electrical blade switch of claim 6, wherein (a) said springs are helical springs

9. The electrical blade switch of claim 6, with the addition of (a) a roller engaged with the movable portion of said second contact leaf to effect deflection of said movable portion when said roller engages a projection on a surface.

* * * * *